US005606215A

United States Patent [19]

Jaskie et al.

[11] Patent Number: 5,606,215

[45] Date of Patent: Feb. 25, 1997

[54] FIELD EMISSION DEVICE ARC-SUPPRESSOR

[75] Inventors: James E. Jaskie; Lawrence N. Dworsky, both of Scottsdale; Dean Barker, Tempe, all of Ariz.

[73] Assignee: Motorola, Inc., Schaumburg, Ill.

[21] Appl. No.: 644,925

[22] Filed: May 13, 1996

Related U.S. Application Data

[63] Continuation of Ser. No. 283,363, Aug. 1, 1994, abandoned.

[51] Int. Cl.[6] ..... H01J 1/02

[52] U.S. Cl. ..... 313/309; 313/336

[58] Field of Search ..... 313/306, 309, 313/310, 336, 351, 495, 496, 497

[56] References Cited

U.S. PATENT DOCUMENTS

| | | | |
|---|---|---|---|
| 5,142,184 | 8/1992 | Kane | 313/309 |
| 5,173,634 | 12/1992 | Kane | 313/309 |
| 5,283,500 | 2/1994 | Kochanski | 313/309 |
| 5,396,150 | 3/1995 | Wu et al. | 313/309 |
| 5,412,285 | 5/1995 | Komatsu | 313/309 |
| 5,430,348 | 7/1995 | Kane et al. | 313/309 |
| 5,442,193 | 8/1995 | Jaskie et al. | 313/309 |

*Primary Examiner*—Michael Horabik
*Assistant Examiner*—Michael Day
*Attorney, Agent, or Firm*—Robert F. Hightower; Eugene A. Parsons

[57] ABSTRACT

A field emission device (10) has a gate (17) including an opening (22) for the communication of electrons from an emitter (14) to an anode (16). A resistive layer (18) is disposed at least on the inner surface (23) of the gate (17) surrounding the opening (22). The field emission device (10) may further include an insulating, dielectric layer (19). The resistive layer (18) and the dielectric layer (19) reduce arcing between the emitter (14) and the gate (17) in the field emission device (10).

10 Claims, 1 Drawing Sheet

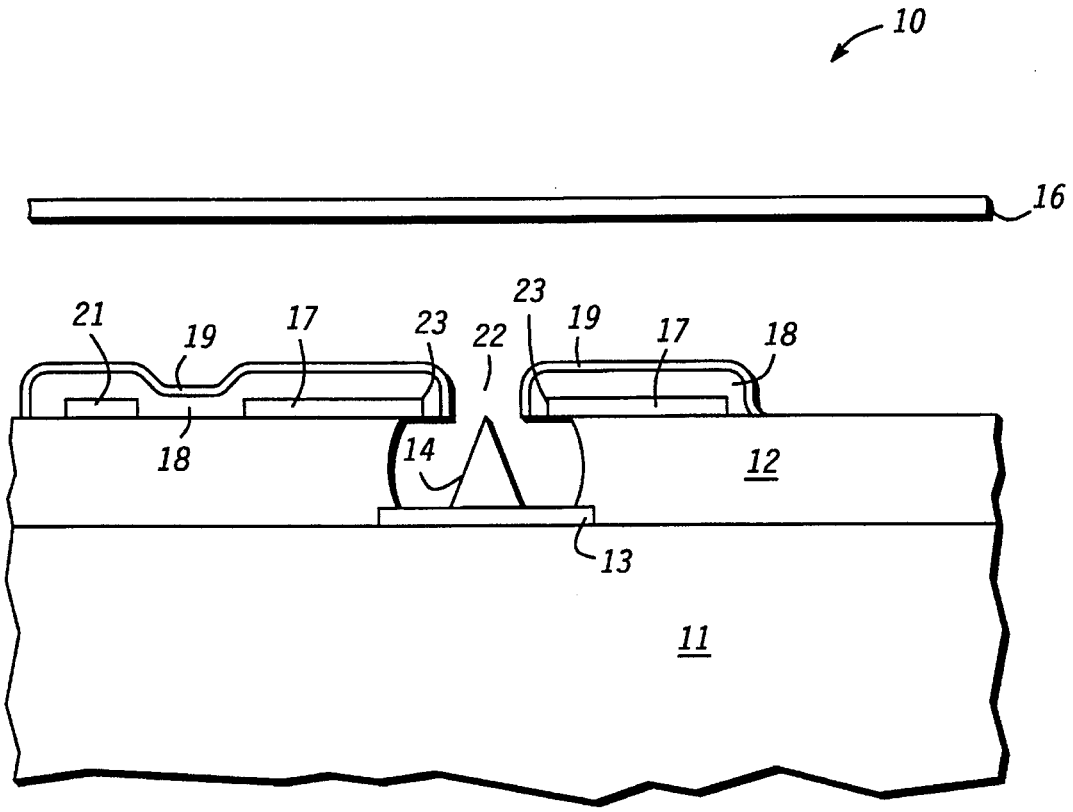
10
16
21
19
17
23
22
23
19
17
18
18
14
12
13
11

FIELD EMISSION DEVICE ARC-SUPPRESSOR

This application is a continuation of prior application Ser. No. 08/283,363, filed on Aug. 1, 1994, now abandoned.

BACKGROUND OF THE INVENTION

The present invention relates, in general, to electron emission devices, and more particularly, to a novel arc-suppressor for field emission devices.

Field emission devices (FEDs) are well known in the art and are commonly employed for a broad range of applications including image display devices. An example of a FED is described in U.S. Pat. No. 5,142,184 issued to Robert C. Kane on Aug. 25, 1992. Prior FEDs typically have a cathode or emitter that is utilized to emit electrons that are attracted to a distally disposed anode. A voltage differential is created between the emitter and an extraction grid or gate in order to facilitate electron emission from the emitter. Often, arcing or breakdown occurs between the emitter and the gate causing large current flow through the emitter. The breakdown can result from, among other things, an inefficient vacuum or from insufficient distance between the emitter and the gate. The breakdown generally damages or destroys the emitter.

Accordingly, it is desirable to have a field emission device that prevents damaging the emitter during breakdown between the emitter and gate, and that substantially prevents breakdown between the emitter and gate.

BRIEF DESCRIPTION OF THE DRAWINGS

The sole FIGURE illustrates an enlarged cross-sectional portion of a field emission device in accordance with the present invention.

DETAILED DESCRIPTION OF THE DRAWINGS

The sole FIGURE illustrates an enlarged cross-sectional portion of a field emission device (FED) 10 that has a novel emitter to gate breakdown suppression scheme. Device 10 includes a substrate 11 on which other portions of device 10 are formed. Substrate 11 typically is an insulating or semi-insulating material, for example, glass or a silicon wafer having a layer of silicon oxide. A cathode conductor 13 generally is on substrate 11 and is utilized to make electrical contact to a cathode or emitter 14. Conductor 13 typically is used to interconnect a plurality of emitters in a column configuration. Such column configurations are well known to those skilled in the art. Emitter 14 emits electrons that are attracted to an anode 16 that is distally disposed from emitter 14. The space between emitter 14 and anode 16 generally is evacuated to form a vacuum. A first dielectric or insulator 12 is formed on substrate 11 and also on a portion of conductor 13 in order to electrically isolate emitter 14 and conductor 13 from an extraction grid or gate 17 that is formed on insulator 12. Gate 17 typically is a conductive material having an emission opening 22 that is substantially centered to emitter 14 so that electrons may pass through gate 17. Typically, electron emission from emitter 14 is stimulated by creating a voltage differential between emitter 14 and gate 17. A voltage differential of approximately ten volts to one hundred volts generally is utilized to stimulate the electron emission.

In prior art FEDs, breakdown occurs between the emitter and the gate if the emitter is sufficiently close to the gate so that the voltage differential exceeds the breakdown voltage of the space between the emitter and gate. Also if the space between emitter 14 and gate 17 does not have a sufficient vacuum, the breakdown voltage can be less than the voltage differential, thereby, resulting in breakdown or arcing between emitter 14 and gate 17.

In order to prevent breakdown and arcing from damaging emitter 14, a resistive layer 18 is applied to an inside surface 23 of opening 22, and to a top surface of gate 17. Although not shown, layer 18 may also cover a portion of the bottom surface of gate 17. The material used for layer 18 and the thickness of layer 18 is sufficient to provide a resistance that limits current flow between emitter 14 and gate 17 to a value that will not damage emitter 14. Any of a variety of resistive materials that are well known to those skilled in the art can be utilized for layer 18. Examples of such materials include, amorphous silicon, silicon rich silicon oxide, and diamond-like carbon. As used herein, "diamond-like carbon" means carbon in which the bonding is formed by carbon atoms bonded generally into the well known diamond body, commonly referred to as an abundance of $sp^3$ tetrahedral bonds, and includes diamond as well as other material containing the diamond bond. Additionally, metals can also be applied and then oxidized in order to form layer 18 wherein the oxidized portion forms layer 18. For example, molybdenum, tantalum, or aluminum can be applied and then oxidized to form molybdenum oxide ($Mo_2O_3$), tantalum oxide ($TaO_2$), or aluminum oxide ($Al_2O_3$), respectively.

Preferably, the portion of layer 18 that is on surface 23 provides a resistance of at least approximately one Megohm to gate 17, that is, from the outside surface of layer 18, through layer 18, to gate 17. Such a resistance has been found to limit current flow between emitter 14 and gate 17 to a value that does not damage emitter 14. The thickness and resistivity of layer 18 generally are chosen to provide such a resistance. In the preferred embodiment, layer 18 is a silicon rich silicon oxide having a thickness of at least approximately 0.1 microns and a resistivity of at least one hundred ohm-centimeter. Generally, the thickness of layer 18 is at least 0.01 microns and can be 1.0 microns or thicker, however, it is important that opening 22 remain sufficiently large to allow electrons emitted from emitter 14 to strike anode 16.

Additionally, a portion of resistive layer 18 can be disposed between gate 17 and a row conductor or gate conductor 21 that is utilized to provide an electrical connection to gate 17. The portion of resistive layer 18 between conductor 21 and gate 17 functions as a series resistor that limits current flow from conductor 21 to gate 17. By placing such a series resistor between conductor 21 and gate 17 power dissipation is reduced over prior art embodiments that utilize a series resistor between an emitter and an external power source. Utilizing a portion of layer 18 as a series resistor is an optional embodiment that provides the additional low power dissipation advantage to the use of layer 18.

Furthermore, an optional dielectric layer 19 may be applied over resistive layer 18 to further increase the resistance between gate 17 and emitter 14. However, it should be noted that insulators develop a charge buildup that eventually results in a destructive breakdown arc between the insulator and emitter 14. Consequently, the thickness of layer 19 must be sufficiently thin to maintain a high resistance path between emitter 14 and gate 17. This high resistance path allows charge buildup to be dissipated through the resistive path thereby preventing a destructive arc. In the preferred embodiment, layer 19 is less than approximately 0.03 microns thick.

By now it should be appreciated that there has been provided a field emission device with a novel arc-suppressor or breakdown suppression scheme. By utilizing a high resistance material on the inside of the emission opening of a gate of the field emission device, the emitter is protected. Because of the resistive layer, the amount of current that may flow between gate 17 and emitter 14 during an arc is limited to a value that does not destroy emitter 14.

We claim:

1. A field emission device arc-suppressor comprising:

a substrate;

a first insulating layer on the substrate;

a conductive gate layer on the first insulating layer, the conductive gate layer having an emission opening through the conductive gate layer for allowing electrons to pass through the conductive gate layer, a top surface surrounding the emission opening, a bottom surface surrounding the emission opening, and an inner surface on the inside of the emission opening; and a resistive layer on the top surface and extending onto the inner surface wherein the resistive layer on the inner surface provides a resistance of at least approximately one Meg-ohm.

2. The device of claim 1 wherein the resistive layer has a resistivity of at least 100 ohm-cm.

3. The device of claim 1 wherein the resistive layer is one of amorphous silicon, diamond-like carbon, molybdenum oxide, silicon oxide, or aluminum oxide.

4. The device of claim 1 wherein the resistive layer on the inner surface has a thickness of at least approximately 0.1 microns.

5. The device of claim 1 further including a second insulating layer on the resistive layer.

6. The device of claim 1 further including a row conductor on the first insulating layer, the row conductor spaced apart from the conductive gate layer wherein a portion of the resistive layer is in electrical contact with the row conductor.

7. A field emission device arc-suppressor comprising:

a conductive gate layer;

an emission opening through the conductive gate layer for allowing electrons to pass through the conductive gate layer, the emission opening having an inner surface; a resistive layer on the inner surface.

8. The device of claim 7 wherein the resistive layer provides a resistance of at least approximately one Megohm to the inner surface.

9. The device of claim 7 wherein the resistive layer has a resistivity of at least approximately 100 ohm-cm.

10. The device of claim 7 further including a portion of the resistive layer on a top surface of the conductive gate layer.

* * * * *